US007264561B2

(12) United States Patent
Scarpa, III et al.

(10) Patent No.: US 7,264,561 B2
(45) Date of Patent: Sep. 4, 2007

(54) TENNIS NET SINGLES SUPPORT STICK ASSEMBLY

(76) Inventors: Ed Scarpa, III, 2102 Atlantic Ave., Sullivan's Island, SC (US) 29482; Nicholas Johannes, P.O. Box 1043, Isle of Palms, SC (US) 29451

( * ) Notice: Subject to any disclaimer, the term of this patent is extended or adjusted under 35 U.S.C. 154(b) by 0 days.

(21) Appl. No.: 11/418,569

(22) Filed: May 6, 2006

(65) Prior Publication Data

US 2007/0099732 A1 May 3, 2007

Related U.S. Application Data

(60) Provisional application No. 60/732,817, filed on Nov. 2, 2005.

(51) Int. Cl.
*A63B 61/00* (2006.01)

(52) U.S. Cl. ..... 473/494

(58) Field of Classification Search ..... 473/490, 473/492, 494

See application file for complete search history.

(56) References Cited

U.S. PATENT DOCUMENTS

| | | | | |
|---|---|---|---|---|
| 3,998,455 | A | 12/1976 | Billmeyer | |
| 4,010,951 | A | 3/1977 | Gronlund | |
| 4,030,733 | A | 6/1977 | Merrihew et al. | |
| 4,088,317 | A | 5/1978 | Gierla | |
| 4,119,301 | A | 10/1978 | Payne | |
| 4,291,875 | A | 9/1981 | Smith, Jr. | |
| 4,440,393 | A | 4/1984 | Smith, Jr. | |
| 4,638,998 | A | 1/1987 | Shannon, Jr. | |
| 4,844,455 | A | 7/1989 | Funkhouser, Jr. | |
| 4,976,432 | A | 12/1990 | Cheney | |
| 5,320,344 | A | 6/1994 | Henderson | |
| 6,482,112 | B1 | 11/2002 | Betz | |
| 6,595,496 | B1 | 7/2003 | Langlie et al. | |
| 6,926,626 | B2 * | 8/2005 | Scarpa, III | 473/492 |
| 7,059,980 | B1 | 6/2006 | Shannon, Jr. | |
| 2005/0090338 | A1 * | 4/2005 | Scarpa, III | 473/492 |
| 2005/0164811 | A1 | 7/2005 | Barbier | |

FOREIGN PATENT DOCUMENTS

| | | | |
|---|---|---|---|
| AU | 2003255601 | A1 | 12/2003 |
| DE | 297 03 884 U 1 | | 10/1997 |
| EP | 1 509 286 | A1 | 3/2005 |
| EP | 1 509 286 | B1 | 12/2005 |
| FR | 2 839 896 | A1 | 11/2003 |
| FR | 2 839 896 | B1 | 11/2003 |
| FR | 2883195 | * | 9/2006 |
| WO | WO 03/099391 | A1 | 12/2003 |

* cited by examiner

*Primary Examiner*—Raleigh W. Chiu
(74) *Attorney, Agent, or Firm*—Fulwider Patton LLP

(57) ABSTRACT

A tennis net support stick is retained by a housing that is present on a tennis net support post or stile. A reel may be connected to the tennis net support stick by means of a line, cable, wire or similar apparatus to a pole of precise length, called a support stick, which supports a tennis net at a required distance from the court lines during a singles tennis match. The line, cable, wire or similar apparatus provides a pre-determined distance of the support stick from the tennis net support post, whereas the support stick length ensures a regulation height of the net.

21 Claims, 4 Drawing Sheets

TENNIS NET SINGLES SUPPORT STICK ASSEMBLY

Applicant claims the benefit of Provisional Application Ser. No. 60/732,817 filed Nov. 2, 2005.

FIELD OF THE INVENTION

This invention relates to tennis generally, and is more specifically related to a support device for a tennis net.

BACKGROUND OF THE INVENTION

Most tennis courts are designed and constructed to accommodate doubles matches, wherein two players play against two opponents at the same time. Singles matches are played on the same court, using a different set of game lines, demarcating a narrower out-of-bounds. The tennis court size for a doubles match is 54 inches wider on each side of the center line than a singles tennis court.

According to the international tennis rules, each tennis net support post or stile shall be positioned 36 inches outside the out-of-bounds line, lifting the tennis net at that point to a height of 42 inches. As the tennis net sags towards the center, it shall measure 36 inches above the court center line. Since virtually all tennis courts are built to accommodate doubles matches, it is common practice for the distance between the tennis net support posts or stiles to be fixed at the larger distance for doubles matches, rather than the shorter distance for singles practice.

SUMMARY OF THE INVENTION

A tennis net support stick is retained by a housing on tennis net support post or stile. A reel may be contained in a housing fitted to a tennis net support post or stile. The reel may be connected by means of a line, cable, wire or similar apparatus, to a pole of precise length, called a support stick, which supports a generally horizontal top member of a tennis net. The net is supported at the rules required distance from the court lines during a singles match. The line, cable, wire of similar apparatus measures a pre-determined distance of the support stick from the tennis net support post or stile, and the support stick's vertical height ensures a regulation height of the net.

DESCRIPTION OF THE DRAWING FIGURES

DESCRIPTION OF PREFERRED EMBODIMENTS OF THE INVENTION

Figure 1:
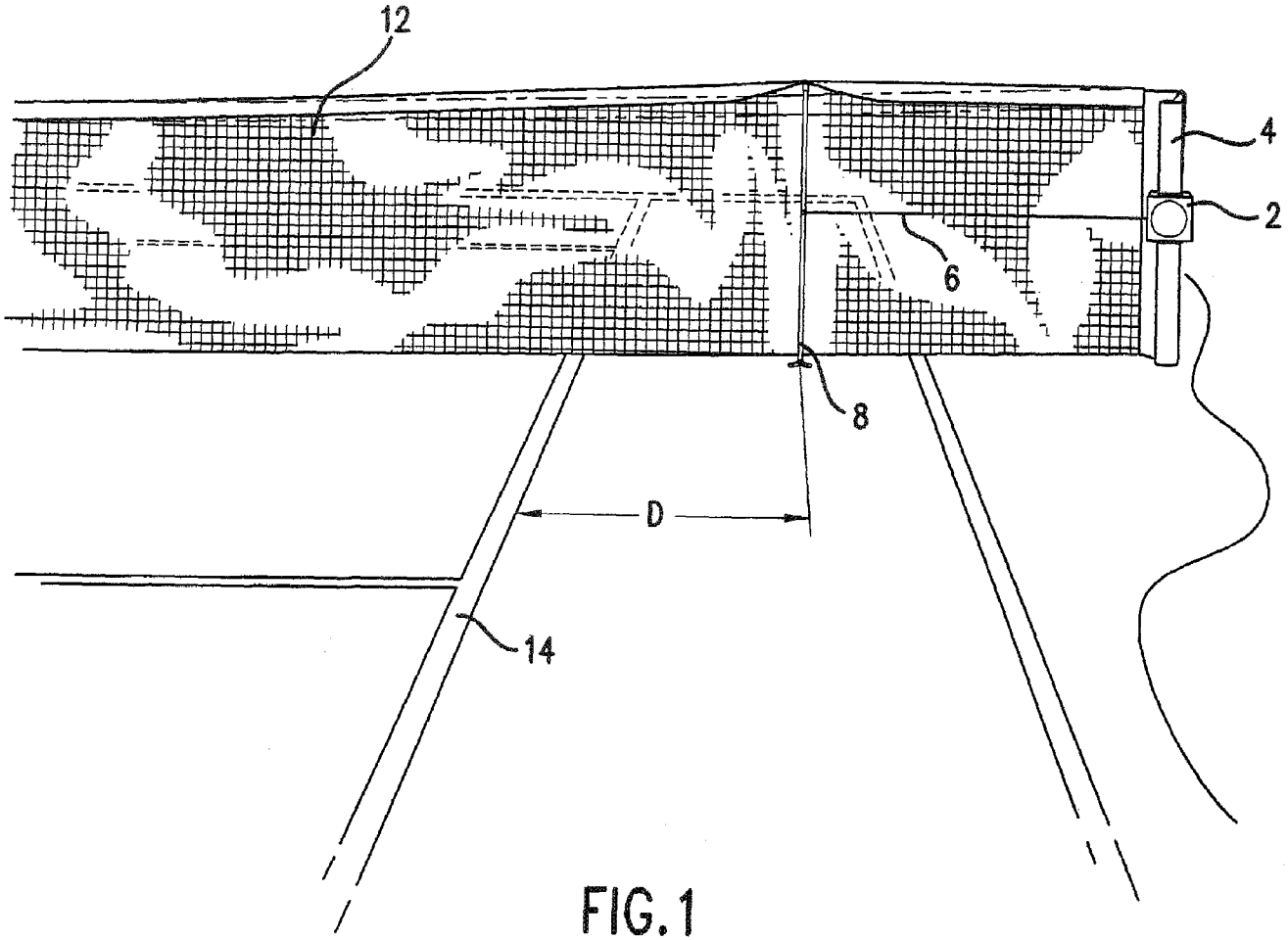
FIG. 1 shows a partial view of a tennis court with a portion of a tennis net present that is supported by a tennis net support post or stile and showing the support stick of the present invention in position for use.

As shown in the drawing figures, in a preferred embodiment, a reel assembly 2 is fitted to a permanently mounted tennis net support post 4 or stile. In one embodiment, a spring biased reel is connected by means of a line 6, cable, wire or similar apparatus to a pole of precise length, called a support stick 8. The support stick supports a generally horizontal cable 10 located at or near the top of the tennis net 12. The support stick is positioned at the rules required distance D from the court lines 14 during a singles match by the length of the extended line from the reel 16. The line, when fully extended from the reel, provides a pre-determined distance of the support stick from the tennis net support post or stile, whereas the generally vertical support stick length ensures a regulation height of the net. When not in use, the spring-biased reel retracts the pole, which, in the preferred embodiment, is pulled into a recess 18 in the housing 20 of the reel assembly and is held in place against and parallel to the tennis net support post. The reel assembly may be covered with an attractive housing, which can accommodate a clock, advertising, displays, or all of the above or other indicia.

The housing 20 may comprise two separate assemblies, each which may be attached, such as by clamping, to a tennis net support post or stile on a tennis court. In one embodiment, the reel assembly comprises a housing having two parts, one of which firmly accommodates a sprung cable or wire reel 16. At the end of the line extending from the reel an adjustable eyelet attachment, or rubber grommet, may be present to attach the line to the support stick. The eyelet or grommet attachment may be tightly fitted, but is preferred to be slidable relative to the support stick to adjust the parallel height of the point on the tennis net support post where the cable reel is attached.

The support stick may be a generally vertical rod or tube, and may have a rubber ferrule at the bottom and a V-shaped end at the top. The V-shape split holds the tennis net cable, while the ferrule prevents the rod from damaging the court surface. In one embodiment, the rod has a foot 22 at the bottom, and a head 24 that is formed to receive the horizontal support member 10 and the top structure 26 of the net.

The line extending generally horizontally from the reel, when fully extended, maintains a distance between the reel attached to the tennis net support post, and the support stick, of preferably between 50 and 58 inches, and most preferably 54 inches, or such other distance D determined by the required placement of the support stick for play relative to the court lines.

The tension of the spring of the reel is sufficient to rewind the line, cable, wire or string of any material and to pull the support stick into its recess in the housing after the support stick is removed from under the net. The tension of the reel is sufficient to retract the support stick automatically when it is not in position under the net, so that the support stick is not inadvertently positioned away from the support post, where the post or the line is subject to damage, or where the support stick would interfere with play. The tension on the reel is not sufficient to pull the support stick from its position under the net when the support stick is in position for play.

When the support stick is removed from its position under the net, it is preferred that the tension provided by the reel automatically retracts the support stick to the tennis net support post, and preferably the support stick is automatically positioned in its resting recess 18 close to the tennis net support post. A handle or crank for winding the cable, wire or string may be provided, but is not necessary to the preferred embodiment when properly functioning, since spring biasing will retract the line to the reel without the user having to wind the device by means of a handle or crank.

The reel attached to a tennis net support post or stile or the support stick can be of any suitable structure that meets the goals and requirements of the invention, and may be a direct-pull type, which is installed on the side of the tennis net support post, or a turbine type reel, which is mounted on the front of the tennis net support post and pulled perpendicularly to the reel, or other line or it may be other wire, line or cable retracting devices that are suitable for the purposes of the invention described herein.

The reel may be attached to the tennis pole or the support stick in several ways. The attachment may be accomplished by a fastener, such as screws or rivets, or by Velcro or Tie-Rap. The support stick may be connected to the tennis net support post by a line that may be a durable string, rope, chain, wire, or cable (the term "line" is used herein to mean any of these devices), without having a reel to accommodate for the slack thereof. The support stick may be attached to the tennis post by way of a mechanically fixed or extendable device other than a cable, rope, wire, string or chain.

The device of the preferred embodiment is used by pulling the support stick from the recess in the housing. The support stick is positioned under the net, and in held in place by the weight of the net resting upon the support stick. The height of the support stick is the required height by tennis rules, and is of a height that will hold the top of the net at forty two (42) inches at the point of engagement of the support stick with the tennis net. The wire, string or cable attached to the support stick limits the travel of the support stick. After use, the spring biased reel retracts the support stick into the recess, preferably automatically, so that the support stick will not be lost or broken or interfere with play such as doubles play.

Figure 2:
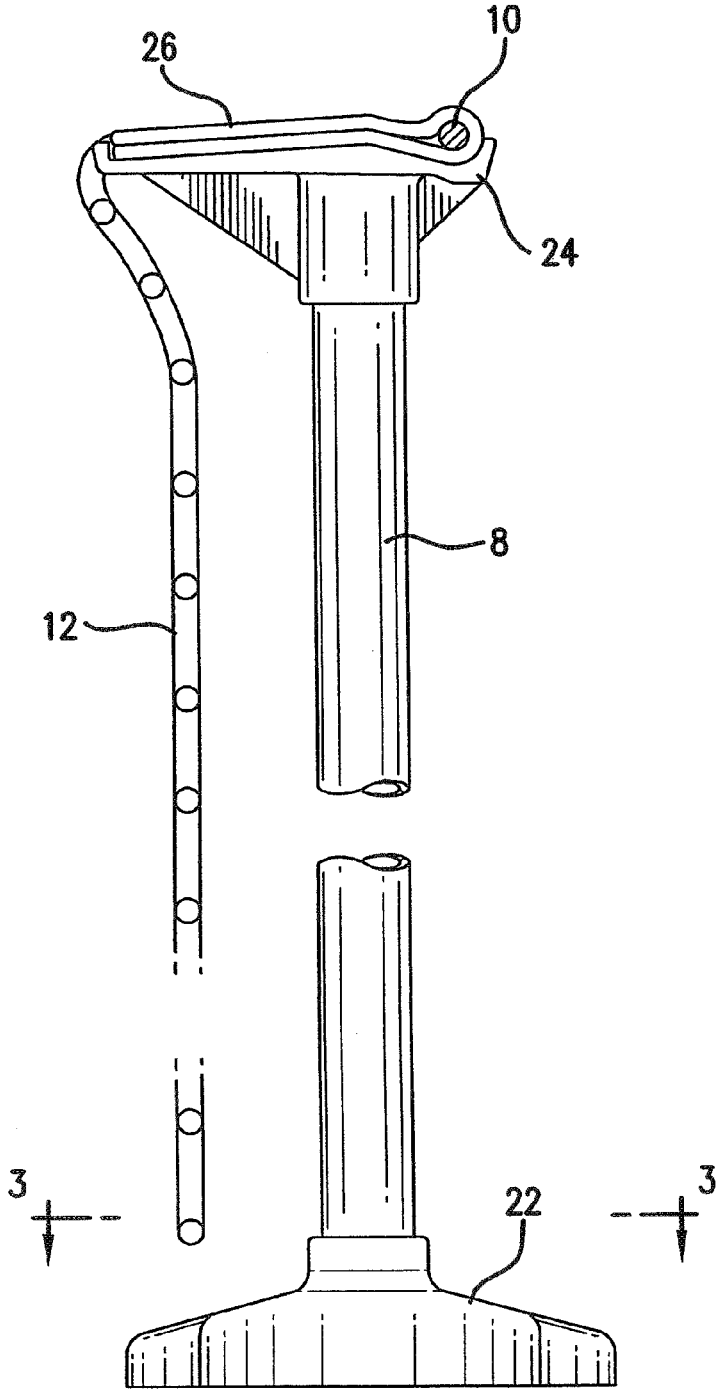
FIG. 2 is an elevation of the support stick of the present invention.
Figure 3:
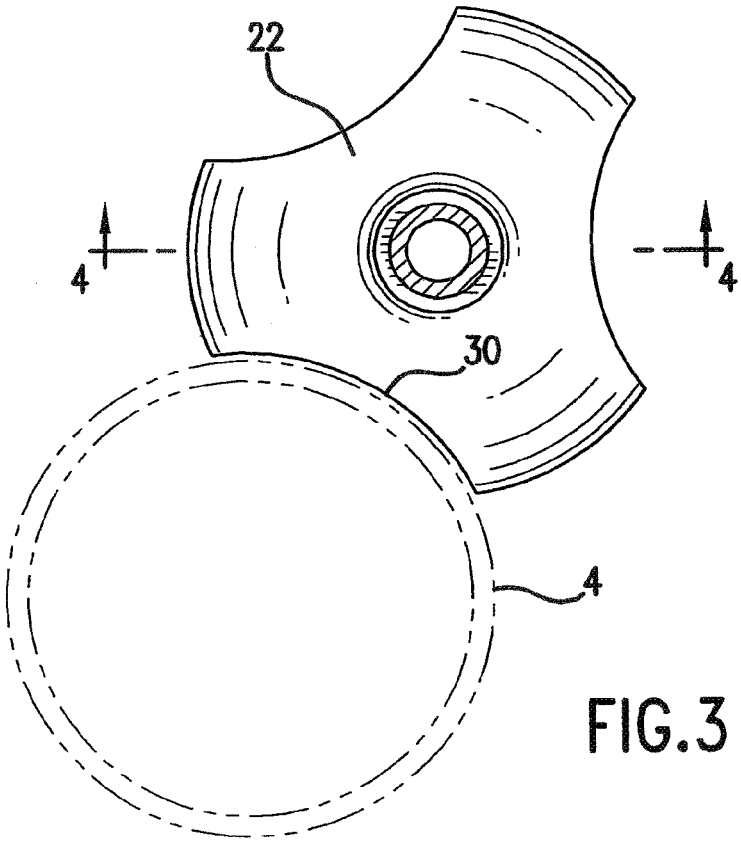
FIG. 3 is a sectioned view of the support stick taken essentially along line 3-3 of FIG. 2, with a section of a tennis net support post shown as a phantom.
Figure 4:
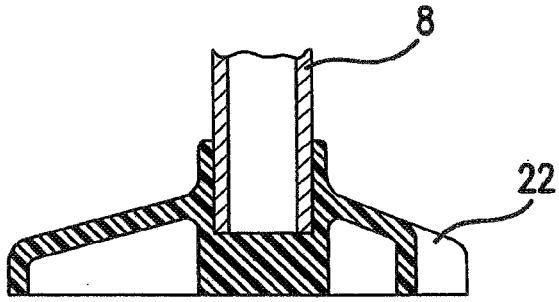
FIG. 4 is a sectioned view of the support stick taken essentially along line 4-4 of FIG. 3.
Figure 5:
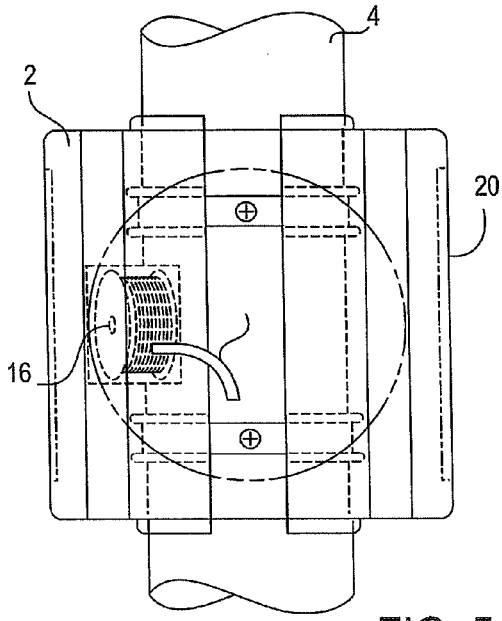
FIG. 5 is an elevation of the reel portion of the present invention demonstrating the invention as attached to a tennis net support post.
Figure 6:
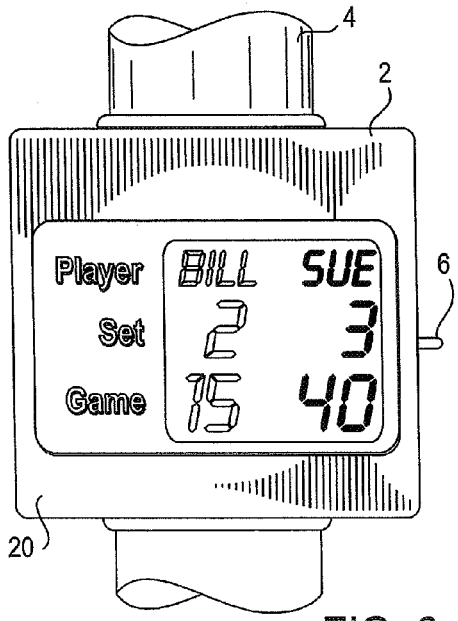
FIG. 6 is an elevation of the reel of the present invention demonstrating the invention as attached to a tennis net support post, and showing a side of the device that on an obverse side relative to the side shown in FIG. 5.
Figure 7:
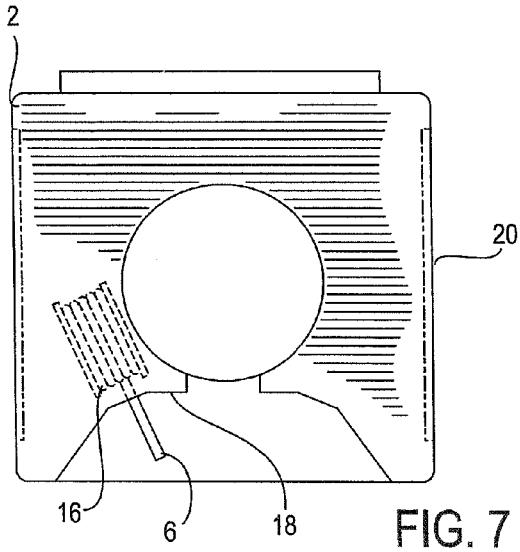
FIG. 7 is a top plan view of the reel of the present invention demonstrating the invention as attached to a tennis net support post.

As shown in the embodiment of FIG. 2, the head 24 of the support stick is adapted to receive the top of the tennis net. In this embodiment, the head has a lip on one end, a downwardly sloping but generally flat portion, and a horizontal support 10 receiving depression. The head covers a top portion of the support stick 8 and maintains the horizontal support at forty two (42) inches vertically above the playing surface.

As shown in the embodiment of FIG. 2, a foot is present on the bottom of the support stick. The foot is preferred to have a generally arcuate and concave side 30, or multiple generally concave sides. The generally concave side receives the tennis net support post. The generally concave side, in conjunction with the preferred generally concave side 18 of the reel housing allows the support stick to be pulled closely against the permanently fixed tennis net support post, so that the support stick is less subject to breakage or damage, and the support stick is positioned out the way of doubles play.

The housing may be square, cylindrical, tubular, round, elliptical or any other shape, but is capable of having advertising or other information indicia thereon, such as court number or scoring information. The indicia may be electronically formed, changed or manipulated, such as by incorporated computer generated graphic images from a computer that is integral with, or remote from, the housing. A clock, LCD display or similar device may be displayed from or by the housing. The housing is preferred to have a width on the any side that does not exceed the width of the rules permitted by the rules of tennis, which is currently a width of six (6) inches. The length of the housing may be up to the length of the tennis pole plus one (1) inch, or forty three (43) inches, as permitted by tennis rules.

What is claimed is:

1. A tennis net support comprising:

a housing that is adapted for attachment to a generally vertical tennis net support post, a generally vertical tennis net support stick, wherein an upper portion of said tennis net support stick is adapted to receive a horizontal support of a tennis net, a flexible line coupling said housing to said support stick; and wherein said tennis net support stick is retained by said housing.

2. A tennis net support as described in claim 1, wherein said housing comprises a reel, wherein said reel is connected by said line to said generally vertical tennis net support stick.

3. A tennis net support as described in claim 2, wherein said reel is contained within said housing, and said housing surrounds a portion of said tennis net support post.

4. A tennis net support as described in claim 2, wherein said reel comprises spring biasing, and wherein said spring biasing of said reel urges said line and said support stick towards said reel.

5. A tennis net support as described in claim 2, wherein, when said line is fully extended from said reel, a distance from said support stick to said generally vertical tennis net support post is between 125 centimeters and 145 centimeters.

6. A tennis net support as described in claim 2, wherein said reel comprises spring biasing, and wherein said spring biasing of said reel constantly uges said line and said support stick towards said reel.

7. A tennis net support as described in claim 2, wherein, when said line is fully extended from said reel, and said support stick is engaged under said horizontal support of said tennis net, a top of said tennis net at said support stick is between forty (40) and forty two (42) inches from a tennis court playing surface, when measured vertically.

8. A tennis net support as described in claim 2, wherein said housing comprises a generally flat and vertical side, and said housing comprises a generally concave side that receives said generally vertical tennis net support stick therein when said line is substantially fully retracted into said reel.

9. A tennis net support as described in claim 2, wherein said housing comprises a generally concave side that receives said generally vertical tennis net support stick therein when said line is substantially fully retracted into said reel, adn wherein said line extends from said generally concave side of said reel.

10. A tennis net support as described in claim 2, wherein said housing comprises a generally flat and vertical side, and wherein said housing comprises a generally concave side that receives said generally vertical tennis net support stick therein when said line is substantially fully retracted into said reel, and wherein said line extends from said generally concave side of said reel.

11. A tennis net support as described in claim 1, wherein said housing comprises a generally flat and vertical side.

12. A tennis net support as described in claim 1, wherein said housing comprises three generally flat and vertical sides.

13. A tennis net support as described in claim 1, wherein said housing comprises a generally flat and vertical side, and wherein said generally flat and vertical side comprises informational indicia.

14. A tennis net support as described in claim 1, wherein said generally vertical tennis support stick comprises a foot, and wherein said foot comprises a side that is generally concave, and wherein said tennis net support post is received within said side of said foot of said tennis net support stick that is generally concave.

15. A tennis net support as described in claim 1, wherein said generally vertical tennis net support stick comprises a head on an upper end thereof, wherein said head has a lip on one end thereof, a downwardly sloping but generally flat top portion, and a horizontal support receiving depression that is positioned on a top of said head between said lip and said downwardly sloping but generally flat top portion.

16. A tennis net adjusting apparatus for establishing a regulation height of a tennis net at a predetermined position comprising:

an elongate member having an upper end adapted to receive a net cable thereon, and a lower end configured with a base to support said elongate member, a distance between said upper end and said base establishing said regulation height of said tennis net;

a housing affixable to a portion of a tennis net support post; and a flexible line connecting said housing to said elongate member, said flexible line having a length selected to identify said predetermined position.

17. The tennis net adjusting apparatus of claim 16 wherein said flexible line is retractable on a reel within said housing.

18. The tennis net adjusting apparatus of claim 16 wherein said housing includes a recess configured to receive at least a portion of said elongate member when said flexible line is retracted on said reel within said housing.

19. The tennis net adjusting apparatus of claim 16 wherein said housing further comprises advertising indicia thereon.

20. The tennis net adjusting apparatus of claim 16 wherein said housing further comprises indicia displayed electronically by a computer.

21. The tennis net adjusting apparatus of claim 16 wherein said housing further comprises an LCD display.

* * * * *